US005363670A

United States Patent [19]

Bartilucci

[11] Patent Number: 5,363,670

[45] Date of Patent: Nov. 15, 1994

[54] SELF-CONTAINED COOLER/FREEZER APPARATUS

[76] Inventor: Anthony Bartilucci, 3434 S. Hawthorne Dr., Wantagh, N.Y. 11793

[21] Appl. No.: 47,957

[22] Filed: Apr. 19, 1993

[51] Int. Cl.[5] ..... F25D 3/12

[52] U.S. Cl. ..... 62/166; 62/168; 62/388

[58] Field of Search ..... 62/165, 166, 167, 168, 62/372, 384, 387, 385, 388, 383

[56] References Cited

U.S. PATENT DOCUMENTS

| | | | |
|---|---|---|---|
| 1,963,674 | 6/1934 | Pearsons | 62/166 |
| 1,980,089 | 11/1934 | Rice, Jr. | 62/167 |
| 2,026,353 | 12/1935 | Mayer | 62/165 |
| 2,057,489 | 10/1936 | Hopwood | 217/19 |
| 2,608,832 | 9/1952 | Woods | 62/168 |
| 3,071,045 | 1/1963 | Budd | 93/1 |
| 3,225,558 | 12/1965 | Wulfken | 62/167 |
| 3,225,822 | 12/1965 | Westling | 165/48 |
| 3,287,925 | 11/1966 | Kane et al. | 62/51 |
| 3,316,726 | 5/1967 | Pauliukonis | 62/55 |
| 3,385,073 | 5/1968 | Snelling | 62/45 |
| 3,561,226 | 2/1971 | Rubin | 62/66 |
| 3,633,381 | 1/1972 | Haaf | 62/222 |
| 3,695,056 | 10/1972 | Glynn et al. | 62/168 |
| 3,864,936 | 2/1975 | Frank et al. | 62/385 |
| 3,959,982 | 6/1976 | Denis et al. | 62/223 |
| 3,961,925 | 6/1976 | Rhoad | 62/376 |
| 3,977,208 | 8/1976 | Heighton | 62/237 |
| 4,276,752 | 7/1981 | Modler et al. | 62/166 |
| 4,399,658 | 8/1983 | Nielsen | 62/52 |
| 4,407,144 | 10/1983 | Garside | 62/384 |
| 4,459,825 | 7/1984 | Crouch | 62/404 |
| 4,502,293 | 5/1985 | Franklin, Jr. | 62/388 |
| 4,561,262 | 12/1985 | Fredrixon | 62/62 |
| 4,576,017 | 5/1986 | Combs et al. | 62/372 |
| 4,580,411 | 4/1986 | Orfitelli | 62/371 |
| 4,621,500 | 11/1986 | Pagani et al. | 62/45 |
| 4,704,876 | 11/1987 | Hill | 62/388 |
| 4,716,739 | 1/1988 | Harris et al. | 62/78 |
| 4,882,912 | 11/1989 | Fossey | 62/297 |

FOREIGN PATENT DOCUMENTS

| | | | |
|---|---|---|---|
| 435476 | 9/1935 | United Kingdom | 62/168 |
| 48296 | 1/1934 | Denmark | 62/388 |

*Primary Examiner*—Harry B. Tanner
*Attorney, Agent, or Firm*—Pollock, Vande Sande & Priddy

[57] ABSTRACT

A self-contained cooler/freezer apparatus for carrying items in a frozen or refrigerated environment. The apparatus comprises an insulated container which is divided into two portions. The first portion is utilized for item storage and the second portion houses a pressurized coolant compartment for storing a solid coolant; namely, solid carbon dioxide or dry ice. The pressurized coolant compartment comprises removable insulation panel. These insulations panels are utilized to control the rate of heat transfer from the first portion to the dry ice within the pressurized coolant compartment. Based upon number of factors including desired temperature, storage duration, total item weight, the quantity of dry ice and the number of removable insulation panels can be determined. In essence, the pressurized coolant compartment is a controllable heat sink. Within a short period of time, the dry ice starts to sublimate, thereby forming cold gaseous carbon dioxide at a high pressure. The cold gaseous carbon dioxide is circulated throughout the insulated container via a solenoid actuated gas feed valve, thereby further cooling the first portion of the insulated container. A thermostatic controller activates the gas feed valve based upon temperature readings from thermocouples located within the first portion of the insulated container. A pressure relief valve is positioned within the insulated container to prevent the pressure within the insulated container from building beyond a maximum value.

27 Claims, 3 Drawing Sheets

SELF-CONTAINED COOLER/FREEZER APPARATUS

BACKGROUND OF THE INVENTION

1. Field of the Invention

The present invention relates to a self-contained cooler/freezer apparatus, and more particularly, to a self-contained cooler/freezer apparatus which utilizes solid carbon dioxide in the form of blocks or snow to maintain a predetermined temperature within the apparatus.

2. Discussion of the Prior Art

Many shipping and trucking lines use refrigerated containers to carry perishable commodities over long distances. Typically, such containers are designed to carry either frozen foods or foods that must be maintained at higher, but still refrigerated temperatures, such as for example 40 degrees Fahrenheit. There exists a multitude of portable refrigeration devices designed to maintain or preserve perishable commodities at a given temperature for a given period of time. These refrigeration devices utilize various means to maintain the commodities at a given temperature, including compressed gas refrigeration systems, liquid cooled refrigeration systems, and solid cooled refrigeration systems.

An example of a refrigeration system employing compressed gas is set forth in U.S. Pat. No. 3,633,381. U.S. Pat. No. 3,633,381 discloses a portable refrigerator employing an open cycle system. A stored compressed gas, such as carbon dioxide, is passed from a storage container through an evaporator. The evaporator comprises a serpentine passageway for the gas in a surrounding medium such as water, which is maintained frozen due to the passage of the expanding compressed gas through the coiled passageway. The temperature of the evaporated medium is lower than the ambient temperature of the interior of the container comprising the storage portion of the refrigerator which is cooled thereby. The gas passing through the evaporator may be exhausted into the interior of the container whereby the cooler air which is next to the evaporator medium is circulated throughout the interior of the container.

U.S. Pat. No. 3,961,925 discloses a portable self-contained refrigerated storage and transportation container for preserving perishable commodities, and includes an insulated storage chamber for the perishable commodities. A recirculating liquid cooling system is provided within the container and includes conduit and nozzle means disposed within the storage chamber and adapted to spray a liquid coolant, such as chilled brine, directly onto the perishable commodities to maintain them at a uniform cooled temperature. The sprayed liquid coolant is collected in the bottom portion of the storage chamber. A closed refrigeration system is also provided within the container and includes heat exchange means disposed within the bottom portion of the storage chamber for cooling the sprayed liquid coolant which has collected there.

In U.S. Pat. No. 4,502,293, there is disclosed a solid carbon dioxide cooling container. The container includes an insulated top, bottom, opposite sides and opposite end walls. An upstanding transverse insulated hollow housing is mounted within the container adjacent one end thereof and a carbon dioxide snow cabinet constructed from a "good" heat transfer material is disposed within the housing with opposing wall portions of the cabinet and housing passing exteriorly about the cabinet. A heat insulative horizontal baffle is mounted within the container spaced below the top wall and extends between the sidewalls thereof. The baffle defines a cooled air passage beneath the top wall extending lengthwise of the container. The airflow passage includes an outlet end adjacent and in at least reasonably closed communication with the end of the cooled air passage adjacent the aforementioned one container end wall and an inlet end opening outwardly of the housing into the interior of the container below the baffle. The end of the cooled air passage adjacent the other container end wall opens into the interior of the container and a thermostatically controllable air pump structure is provided to effect airflow inwardly of the inlet of the airflow passage, through the airflow passage and into the cooled air passage. In addition, a structure is provided for spray discharging of liquid carbon dioxide into the interior of the upper portion of the cabinet and into the airflow passage at points spaced in order to form carbon dioxide snow thereon.

The above described patents are representative of the various systems available for preserving perishable items. Each of these systems offers varying degrees of cooling capacity, temperature control and temperature control system simplicity. However, none of the above described systems alone offers a self-contained cooler/-freezer apparatus which provides a high cooling capacity and a highly accurate and simplistic temperature control system.

U.S. Pat. No. 4,276,752 discloses a refrigerated cargo container which utilizes solid carbon dioxide as a cooling medium. The refrigerated cargo container comprises a bunker which is filled with solid carbon dioxide or dry ice, a heat exchanger which is in thermal contact with the solid carbon dioxide, a fan, and ducts for circulating carbon dioxide gas through the container. Warm gas from the container's interior and the cargo contained therein rises to the top of the container due to the natural convective flow of gas in the container. This warm gas enters the heat exchanger and causes the solid carbon dioxide to sublime. As the coolant sublimes, the heat exchanger is cooled, and as warm gas passes over this cooled heat exchanger that gas is likewise cooled. A fan can be installed to increase the flow of warm gas from the interior of the container to the heat exchanger. A damper means is located in the duct carrying cold gas from the heat exchanger to control the amount of cool gas entering the container. A control means may also be installed to control the operation of the fans based on temperature differentials.

The above described patent utilizes natural convection of gas within the container in conjunction with a heat exchanger to provide a flow of cooling gas. A fan and damper means are utilized to augment air flow and partially control the circulation of the cooling gas. However, the use of a heat exchanger in direct contact with the dry ice causes pockets of carbon dioxide gas to form as the dry ice sublimates. These pockets create a large thermal resistance between the warmed gas and the dry ice heat sink, thereby limiting the heat rejection capability of the system. Limiting the heat rejection capability prevents the maintenance of lower temperatures within the cargo container. Additionally, in relying solely on natural convection, there is a diminished ability to accurately control and maintain the temperature within the container.

SUMMARY OF THE INVENTION

The present invention is directed to a self-contained cooler/freezer apparatus for holding and preserving items which need to be stored at refrigerated or below freezing temperatures. The apparatus comprises an insulated container, a pressurized coolant compartment for holding solid carbon dioxide, commonly referred to as dry ice, and a temperature control device for maintaining the temperature within the insulated container at a predetermined value. A first portion of the insulated container is adapted to hold the items which need to be stored at refrigerated or below frozen temperatures, and a second portion is adapted to house the pressurized coolant compartment for holding the dry ice. The pressurized coolant compartment comprises a plurality of removable insulation panels for controlling heat energy transfer from the first portion of the insulated container to the solid carbon dioxide within the pressurized coolant compartment. The temperature control device comprises at least one temperature sensing device, such as a thermocouple, mounted within the first portion of the insulated container, a thermostatic controller for setting the desired temperature, and a device, such as a solenoid actuated gas feed valve, for circulating gaseous carbon dioxide throughout the first portion of the insulated container. The gaseous carbon dioxide is formed by the sublimation of the dry ice contained within the pressurized coolant compartment. The temperature control device further comprises a pressure regulating valve, for controlling the temperature at which the solid carbon dioxide sublimates. The circulating gaseous carbon dioxide absorbs the heat load of the first portion of the insulated container thereby lowering the temperature therein. A pressure relief valve located in the first portion of the insulated container vents carbon dioxide gas to the external environment when the pressure within the first portion of the insulated container exceeds a predetermined safe threshold value. Accordingly, gaseous carbon dioxide which has absorbed the heat load is vented to the external environment.

The items to be shipped are loaded into the first portion of the insulated container and a predetermined quantity of dry ice, in block or snow form, is loaded into the pressurized coolant compartment. The control and maintenance of the temperature of the items is accomplished by two mechanisms, which can be classified as a gross cooling mechanism and a fine cooling mechanism. The gross cooling mechanism involves utilizing the dry ice as a heat sink. Within a short period of time after loading the items and dry ice into the insulated container and pressurized coolant compartment respectively, heat entering through the walls, the top, and the base of the insulated container and the heat trapped in the first portion of the insulated container is transferred to the dry ice, thereby causing sublimation to occur and carbon dioxide gas to form. The removable insulation panels within the pressurized coolant compartment determine the amount and rate of heat transfer from the insulated container to the dry ice. If the items within the first portion of the insulated container need to be kept at colder temperatures, a large temperature gradient will develop between the external environment and the first portion of the insulated container; accordingly, large amounts of heat energy will enter from the external environment. To compensate for this influx of heat energy, fewer insulation panels are used thereby allowing more heat to be rejected to the dry ice. If the items within the first portion of the insulated container need to be kept at elevated, but still refrigerated temperatures, there will be less heat transfer and therefore additional insulation panels are utilized to slow down the heat transfer rate. The quantity of insulation panels needed and the quantity of dry ice is calculated as a function of time, desired item temperature, and the anticipated ambient environment temperature. Once the desired item temperature is roughly achieved by natural convection, the fine cooling mechanism is used to precisely maintain and control item temperature.

Given that the temperature at which sublimation occurs at one atmosphere pressure is approximately −109 degrees Fahrenheit, the dry ice contained within the pressurized coolant compartment will continuously generate a quantity of cold gaseous carbon dioxide. When needed, the cold gaseous carbon dioxide is circulated throughout the first portion of the insulated container via the solenoid actuated gas feed valve, thereby cooling the first portion of the insulated container and the items contained therein. The temperature within the first portion of the insulated container is maintained at the predetermined value by the temperature control device. Thermocouples mounted on the walls of the first portion of the insulated container monitor the temperature of the internal environment of the first portion of the insulated container and are connected to the thermostatic controller which is set to a predetermined temperature. When the temperature rises above the predetermined value, as measured by the thermocouples, the thermostatic controller actuates the solenoid actuated gas feed valve which circulates the cold gaseous carbon dioxide around the first portion of the insulated container. The gas feed valve is closed when the desired temperature is achieved. The fine cooling mechanism and the gross cooling mechanism operate simultaneously initially and at any point when the temperature gradient between the first portion and the pressurized coolant compartment is high enough to cause heat transfer through the insulation panels.

The temperature of the gaseous carbon dioxide within the pressurized coolant compartment can also be controlled. Accordingly, more precise control of the temperature within the first portion of the insulated container can be achieved. By varying the pressure within the pressurized coolant compartment, the temperature at which sublimation occurs can be controlled. For example, at one atmosphere pressure (14.7 psi), the temperature at which sublimation occurs is −109 degrees Fahrenheit, whereas at a pressure of 75 psi, the temperature at which sublimination occurs is −70 degrees Fahrenheit. The pressure is controlled by the pressure regulating valve which is also connected to the thermostatic controller and a pressure sensing device mounted within the pressurized collant compartment.

The self-contained cooler/freezer apparatus of the present invention utilizes a simple control system and the very high cooling capacity of dry ice, which is approximately 247 BTU/lb, to permit maintenance of desired product temperature over a wide range of external ambient temperatures for long periods of time. In utilizing dry ice as the coolant, temperatures ranging from sub-zero to 70 degrees Fahrenheit can be maintained for periods exceeding four days. A simplistic temperature control system comprising a gross cooling mechanism which utilizes dry ice as a heat sink and a fine cooling mechanism which circulates cold gaseous carbon dioxide formed from the sublimation of the dry ice, as needed, is used to accurately maintain the temperature within the insulated container and of the items contained therein at a constant value.

The self-contained cooler/freezer apparatus of the present invention is designed in such a manner, and constructed from materials such that the apparatus is inexpensive to operate and environmentally safe. In addition, the materials used in the construction of the apparatus are lightweight, accordingly, the apparatus can be utilized in applications requiring lightweight refrigeration/freezer units. Typical applications for the present invention are in the air freight, cargo ship or overland cross-country shipping of perishable commodities, vendor carts, hand-held ice chests, camping ice chests, or large stationary installations.

DETAILED DESCRIPTION OF THE PREFERRED EMBODIMENTS

Figure 1:
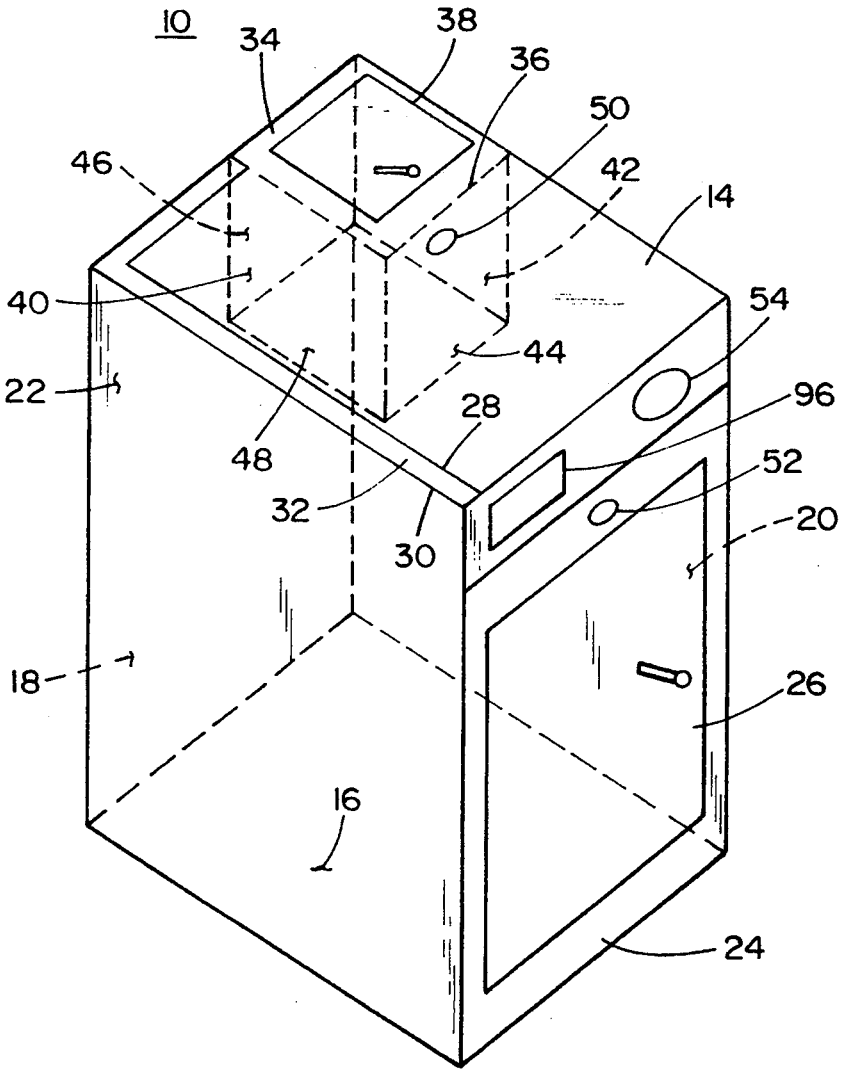
FIG. 1 is a diagrammatic representation of the self-contained cooler/freezer apparatus of the present invention.

The present invention is directed to a self-contained cooler/freezer apparatus or container for holding and preserving items which need to be stored at refrigerated or below freezing temperatures. Referring to FIG. 1, there is shown a diagrammatic representation of the cooler/freezer apparatus 10. The apparatus 10 comprises an insulated container 12, rectangular in shape, having a top 14, a base 16, a pair of side walls 18 and 20, a rear wall 22, and a front wall 24 with an access doorway and door 26. The walls 18, 20, 22 and 24 as well as the top 14, base 16 and access door 26 are constructed from inner and outer hard shells 28 and 30 with a high resistance insulating material 32 sandwiched therebetween. A first portion of the inner volume of the insulated container 12 is utilized to store the items, while a second portion, which is smaller in volume than the first portion, houses a pressurized coolant compartment 34 in which the material used as the refrigerant/coolant is stored. The pressurized coolant compartment 34 is substantially rectangular in shape and comprises a top frame 36, a pair of side walls 40 and 42, a front wall 44, a rear wall 46, and a base 48. The pressurized coolant compartment 34 is mounted in the upper rear portion of the insulated container 12 such that the top frame 36 is substantially flush with the top 14 of the insulated container 12. A coolant compartment access door 38 is mounted to the top frame 36 of the pressurized coolant compartment 34 and rests immediately above the top 14 of the insulated container 12. The rear wall 46 and one side wall 42 of the pressurized coolant compartment 34 lie flush to and are in contact with the rear wall 22 and one side wall 20 of the insulated container 12 respectively. The front wall 44, the base 48, and the second side wall 40 of the pressurized coolant compartment 34 are exposed to the internal volume of the insulated container 12. The pressurized coolant compartment 34 is formed from a thermally conductive material such as aluminum. Mounted in the front wall 34 of the pressurized coolant compartment 34 is a solenoid actuated gas feed valve 50 which circulates gaseous carbon dioxide throughout the first portion of the insulated container 12. Mounted in the front wall 24 of the insulated container 12 is a pressure relief valve 52 which vents the first portion of the insulated container 12 to the external environment when the pressure therein exceeds a predetermined safe threshold value. Also mounted within the front wall 24 of the insulated container 12 is a portion of a battery operated temperature control means; namely, the thermostatic controller 54. In addition, a battery compartment and battery 96 is mounted within the front wall 24 of the insulated container 12, and supplies power for the operation of the cooler/freezer apparatus 10. A detailed description of each of the components or elements discussed above, as well as a description of the operation of the apparatus 10 is given in the subsequent paragraphs.

Figure 2:
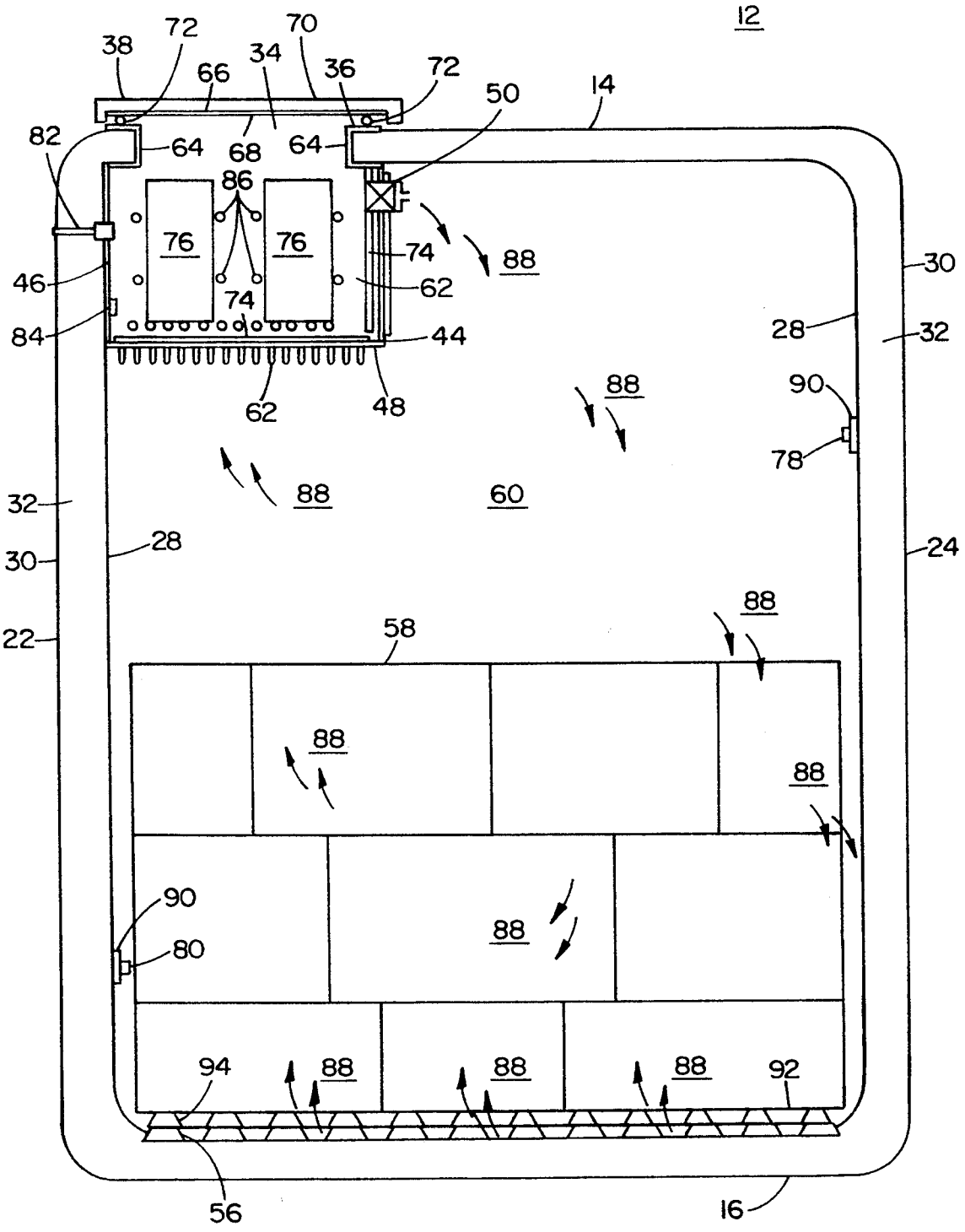
FIG. 2 is a schematic view of the internal structure of the self-contained cooler/freezer apparatus of the present invention.

Turning to FIG. 2, there is shown a schematic view of the internal structure of the self-contained cooler/freezer apparatus 10. As discussed in the preceeding paragraph with respect to FIG. 1, the walls 18, 20, 22 and 24, the top 14, the base 16, and the access door 26 of the insulated container 12 are constructed from inner and outer hard shells 28 and 30 respectively, with a high resistance insulating material 32 sandwiched therebetween. The sandwich type construction is easily seen in FIG. 2. FIG. 2 is a sectional view; accordingly, only the front and rear walls 24 and 22, the top 14 and the base 16 of the insulated container 12 are illustrated. The inner and outer shells 28 and 30 are formed from any suitably rigid material, including but not limited to, fiberglass, aluminum, or stainless steel, which is capable of withstanding various structural loading. The insulating material 32 represents an important design choice in that heat energy transfer into or out of the insulated container 12 must be limited. A polyurethane insulation provides one such suitable design choice. Other materials will obviously suggest themselves to those skilled in the art. The base 16 comprises ridges 56 upon which the items or commodities 58 are placed. These ridges 56 allow for circulation of the coolant gas, which is carbon dioxide in the preferred embodiment, thereby providing for better heat transfer. The inner shell 28 of each of the side walls 18 and 20, illustrated in FIG. 1, and the rear wall 22, comprise corrugations, not shown, so that the items 58 are not placed directly against the side walls 18 and 20 or the rear wall 22, thereby allowing for the free circulation of carbon dioxide gas between the walls 18, 20, and 22 and the items 58. The items 58 occupy the first portion 60 of the insulated container 12. Although the items 58 can entirely fill the first portion 60, the best results are achieved when there is a space between the items 58 and the pressurized coolant compartment 34, thereby allowing for effective heat transfer from the gaseous carbon dioxide contained within the first portion 60 of the insulated container 12 to the pressurized coolant compartment 34.

The pressurized coolant compartment 34 is mounted in the upper rear portion of the insulated container 12. As is stated previously, FIG. 2 illustrates a cross-sectional view of the pressurized coolant compartment 34; accordingly, only the front wall 44, the rear wall 46, the top frame 36, and the base 48 are shown. All four of the walls 40, 42, 44, and 46 and the base 48 of the pressurized coolant compartment 34 are formed from the thermally conductive material such as aluminum, in order to facilitate heat transfer between the gaseous carbon dioxide contained within the first portion 60 of the insulated container 12 and the pressurized coolant compartment 34. The front wall 44, the base 48 and one side wall 40, not shown, are the surfaces of the pressurized coolant compartment 34 which are exposed to the inner volume or first portion 60 of the insulated container 12. Each of these exposed surfaces 40, 44, and 48 comprise a multiplicity of conducting fins 62 which aid in heat transfer between the pressurized coolant compartment 34 and the internal environment of the insulated container 12 as is explained subsequently. All four walls 40, 42, 44 and 46 of the pressurized coolant compartment 34 have grooves 64 into which the edges of the top 14 of the insulated container 12 are mounted. FIG. 2 illustrates the grooves 64 in the front and back walls 44 and 46 of the pressurized coolant compartment 34. A section of the top 14 of the insulated container 12 is removed to provide for the edges which fit into the grooves 64 of the pressurized coolant compartment 34. The grooves 64 provide a snug fit to hold the pressurized coolant compartment 34 in place. The coolant compartment access door 38 of the pressurized coolant compartment 34 is similar in design to the walls of the insulated container 12 in that there is an insulative material 66 sandwiched between an inner and outer shell 68 and 70. A gasket 72 is utilized to provide a pressure seal such that the pressure within the pressurized coolant compartment 34 is maintained at a given level. Attached to the inner surfaces of the exposed surfaces 44, 48 and 40 of the pressurized coolant compartment 34 are removable modular insulation panels 74. In the present design, there are four insulation panels 74 for each exposed surface; accordingly, twelve modular insulation panels 74 are utilized. These modular insulation panels 74 are utilized as part of the overall temperature control means for controlling the temperature within the first portion 60 of the insulated container 12, which is explained in detail subsequently. The removable modular insulation panels 74 lie flush against the exposed surfaces 44, 48 and 40. Also part of the temperature control means is the solenoid actuated gas feed valve 50 which vents cold gaseous carbon dioxide formed by the sublimination of the dry ice 76 contained within the pressurized coolant compartment 34 into the first portion 60 of the insulated container 12. The solenoid actuated gas feed valve 50 is mounted in the front wall 44 of the pressurized coolant compartment 34 and is connected to thermocouples 78 and 80 mounted on the inner shell 28 of the front and rear walls 24 and 22 of the first portion 60 of the insulated container 12, and the battery operated thermostatic controller 54 (shown in FIG. 1). A pressure regulating valve 82, which is mounted in the rear wall 46 of the pressurized coolant compartment 34, vents gaseous carbon dioxide contained within the pressurized coolant compartment 34 to the external environment through the rear wall 22 of the insulated container 12. The pressure regulating valve 82 is connected to the thermocouples 78 and 80, a pressure sensing device 84, and the battery operated thermostatic controller 54 as part of a control loop. The operation of the solenoid actuated gas feed valve 50 and the pressure regulating valve 82 is explained subsequently. A dry ice shelf 86 is utilized to hold blocks of solid carbon dioxide 76. In utilizing a shelf 86, more surface area of the dry ice 76 is exposed, thereby allowing for additional heat transfer. It should be noted that dry ice in snow form as opposed to block form can be utilized. However, if dry ice in snow form is utilized, no shelf 86 is necessary.

In operation, the items 58 to be shipped are loaded into the first portion 60 of the insulated container 12 and a predetermined quantity of dry ice 76, in block or snow form, is loaded into the pressurized coolant compartment 34. The control and maintenance of the temperature of the items 58 is accomplished by two mechanisms, which can be classified as a gross cooling mechanism and a fine cooling mechanism. The fine cooling mechanism and the gross cooling mechanism can operate independently or simultaneously to maintain the temperature within the first portion 60 of the insulated container 12 at the predetermined desired value.

The gross cooling mechanism involves using the dry ice 76 contained within the pressurized coolant compartment 34 as a heat sink. Within a short period of time after loading the items 58 into the first portion 60 of the insulated container 12 and the dry ice 76 into the pressurized coolant compartment 34, heat entering through the top 14, the base 16, the walls 18, 20, 22 and 24, and the access door 26 of the insulated container 12 and the heat within the first portion 60 of the insulated container 12 is transferred to the dry ice 76, thereby cooling the first portion 60 of the insulated container 12 and the items 58 contained therein. The rate and quantity of heat transfer from the first portion 60 of the insulated container 12 to the dry ice 76 is grossly controlled by the number of modular insulation panels 74 utilized. If the items 58 within the first portion 60 of the insulated container 12 need to be stored at very low temperatures, a large temperature gradient will develop between the external environment and the first portion 60 of the insulated container 12. This large temperature gradient will cause high heat energy rates to transfer from the external environment into the first portion 60 of the insulated container 12. Accordingly, in order to maintain the items 58 at a predetermined desired temperature, the heat entering the first portion 60 of the insulated container 12 will have to be transferred to the dry ice 76. To compensate for this large influx of heat energy, fewer modular insulation panels 74 are used, thereby allowing more heat to be transferred to the dry ice 76. Conversely, if the items 58 within the first portion 58 of the insulated container 12 need to be stored at elevated, but still refrigerated temperatures, there will be less heat transfer and therefore more or all of the modular insulation panels 74 are utilized to slow down the rate of heat transfer. When an equilibrium condition is reached, the temperature in the first portion 60 of the insulated container 12 will stabilize at room predetermined value which is slightly greater than the desired item temperature. Given that the equilibrium point may not coincide with the desired item temperature, the fine cooling mechanism is necessary to precisely control and maintain the desired temperature.

The heat transfer from the first portion 60 of the insulated container 12 to the pressurized coolant compartment 34 is by natural convection. The fins 62 mounted to the exposed surfaces 40, 44, and 48 of the pressurized coolant compartment 34 aid in the heat transfer process by increasing the surface area exposed to the first portion 60 of the insulated container 12. The modular insulation panels 74 which lie flush to the walls 40, 44 and base 48 of the pressurized coolant compartment 34 are the means through which the rate and quantity of the gross heat transfer is controlled. The control mechanism lies in the number of modular insulation panels 74 utilized. The quantity of modular insulation panels 74 utilized is a function of desired item temperature, and the anticipated ambient environment temperature. In order to aid the individual preparing a shipment, a matrix or matrix like chart listing the above-described parameters and the corresponding quantity of modular insulation panels 74 to utilize can be developed. In the preferred embodiment, up to twelve modular insulation panels 74 can be utilized; accordingly, there is a factor of twelve by which one can control the heat transfer area and ultimately, the heat transfer rate.

In addition, heat transfer analysis can be performed to determine, the quantity of dry ice 76 which must be loaded into the pressurized coolant compartment 34. Once the desired temperature and weight of the items 58 is known, then the required amount of dry ice 76 can be calculated. Dry ice has an extremely high cooling capacity on the order of 247 BTU/lb; accordingly, the dry ice 76 provides a highly weight efficient heat sink.

The heat energy transferred to the dry ice 76 as part of the gross cooling mechanism causes sublimation to occur and carbon dioxide gas to form in the pressurized coolant compartment 34. Given that the temperature at which sublimation occurs at one atmosphere pressure is approximately −109 degrees Fahrenheit, the dry ice 76 contained within the pressurized coolant compartment 34 will continuously generate a quantity of cold gaseous carbon dioxide. When needed, the cold gaseous carbon dioxide is circulated throughout the first portion 60 of the insulated container 12 via the solenoid actuated gas feed valve 50, thereby lowering the temperature of the first portion 60 of the insulated container 12 and the items 58 contained therein. The temperature within the first portion 60 of the insulated container 12 is maintained at the desired value by this temperature control means. Thermocouples 78 and 80 which are mounted on the inner shell 28 of two of the walls 22 and 24 of the first portion 60 of the insulated container 12 monitor the temperature of the internal environment of the insulated container 12 and are connected to the battery operated thermostatic controller 54 which is set to the desired temperature. When the temperature within the first portion 60 of the insulated container 12 rises above the desired value as measured by the thermocouples 78 and 80, the thermostatic controller 54 actuates the solenoid actuated gas feed valve 50 which circulates cold gaseous carbon dioxide throughout the first portion 60 of the insulated container 12. The arrows 88 indicate the direction of the flow of the cold gaseous carbon dioxide. As is indicated by the arrows 88, the cold gaseous carbon dioxide exits the solenoid actuated gas feed valve 50 and flows downwardly over the items 58. The ridges 56 in the base 16 of the insulated container 12 allow the cold gaseous carbon dioxide to completely circulate around the items 58. The circulation of the gaseous carbon dioxide occurs by natural convection currents. The colder gaseous carbon dioxide from the pressurized coolant compartment 34 is heavier than the carbon dioxide already in the first portion 60 of the insulated container 12, and accordingly, flows downward over the items 58. As the cold gaseous carbon dioxide flows over the items 58, it absorbs heat thereby becoming lighter and will eventually be forced upward as additional cold gaseous carbon dioxide is circulated into the first portion 60 of the insulated container 12. This cold gaseous carbon dioxide absorbs heat from the items 58, thereby also lowering the temperature thereof. When the desired temperature is achieved, the thermocouples 78 and 80 send a signal to the thermostatic controller 54 which in turn outputs a signal to the solenoid actuated gas feed valve 50 to cease circulation of the gaseous carbon dioxide.

As in previously stated, a pressure relief valve 52 is mounted within the front wall 24 of the insulated container 12. The pressure relief valve 52 renews gaseous carbon dioxide within the first portion 60 of the insulated container 12 to the ambient environment when the pressure therein exceeds a predetermined safe threshold value. The pressure relief valve 52 is utilized to prevent damage to the insulated container 12 and the items 58 contained therein. It should be noted that the pressure relief valve 52 vents warmer gaseous carbon dioxide by opening when the solenoid actuated gas feed valve 50 is closed. This action prevents the loss of precious cooling capacity.

Thermocouples 78 and 80 are mounted on the inner shell 28 of the front and rear walls 24 and 22 within the first portion 60 of the insulated container 12. The exact placement and number of thermocouples can vary; however, to more closely reflect the item's 58 thermal response, the thermocouples 78 and 80 can be embedded in heat conductive materials such as small aluminum blocks 90, painted black, and mounted on the inner shell 28 of the front and rear walls 24 and 22. Utilized in this manner, the thermocouples 78 and 80 are used as a measure of the average radiant and convective environment within the first portion 60 of the insulated container 12 and generate an electrical signal proportional to this temperature. The electrical signals are supplied to the thermostatic controller 54 wherein a comparison is made between the electrical signals and the desire temperature setting. If the temperature within the first portion 60 of the insulated container 12 is above the level set on the thermostatic controller 54, the solenoid actuated gas feed valve 50 is actuated by an electrical signal from the thermostatic controller 54. If on the other hand, the temperature is below the preset level, no signal is sent to the solenoid actuated gas feed valve 50 and it remains closed. Being thermodynamically weighted, i.e., mounted within the small aluminum blocks 90, the thermocouples 78 and 80 utilized respond slowly, thereby more closely reflecting the actual item 58 temperature within the first portion 60 of the insulated container 12. It is noted that thermocouples exposed directly to the ambient carbon dioxide environment could also be utilized, but not as effectively.

The thermostatic controller 54, the thermocouples 78 and 80 and the solenoid actuated gas feed valve 50 form the basic control loop of the temperature control means. All of the elements of the control loop are battery powered. The temperature control means provides the fine cooling mechanism for the self-contained cooler/-freezer apparatus 10 by providing for the precise temperature control through the use of feedback, whereas the gross cooling mechanism relies on natural convection and the appropriate calculation of the quantity of modular insulation panels 74 to utilize. The fine cooling mechanism and the gross cooling mechanism can operate independently or simultaneously to maintain the temperature within the first portion 60 of the insulated container 12 at the predetermined desired value. The number of modular insulation panels 74 to be installed for a particular shipment is chosen so that once the gross cooling mechanism reaches an equilibrium condition the temperature in the first portion 60 of the insulated container 12 will stabilize at some value slightly above the desired item temperature. Given that the equilibrium point may not coincide with the desired item temperature, the fine cooling mechanism is necessary to precisely control and maintain the desired item temperature.

The fine cooling mechanism can be further refined to provide additional accuracy. The refinement is possible because the temperature of the gaseous carbon dioxide within the pressurized coolant compartment 34 can be controlled. By varying the pressure within the pressurized coolant compartment 34, the temperature at which sublimation occurs can be controlled. For example, at one atmosphere pressure, 14.7 psi, the temperature at which sublimation occurs is −109 degrees Fahrenheit, whereas at a pressure of 75 psi, the temperature at which sublimation occurs is −70 degrees Fahrenheit. Accordingly, varying the pressure within the range of 1 atmosphere, 14.7 psi, to 75 psi, the temperature of the gaseous carbon dioxide can be varied from approximately −109 degrees to −70 degrees Fahrenheit. The pressure within the pressurized coolant compartment 34 is controlled by the pressure regulating valve 82 which is also connected to the thermostatic controller 54 and forms a sub-loop within the overall temperature control system. The thermostatic controller 54 is connected to, and is responsive to the pressure sensing device 84 which is mounted at a convenient location within the pressurized coolant compartment 34. Basically, when a specific temperature is required, the thermostatic controller 54 reads in a signal from the pressure sensing device 84 and outputs a signal to the pressure regulating valve 82 to open or close thereby changing the pressure within the pressurized coolant compartment 34.

Figure 3:
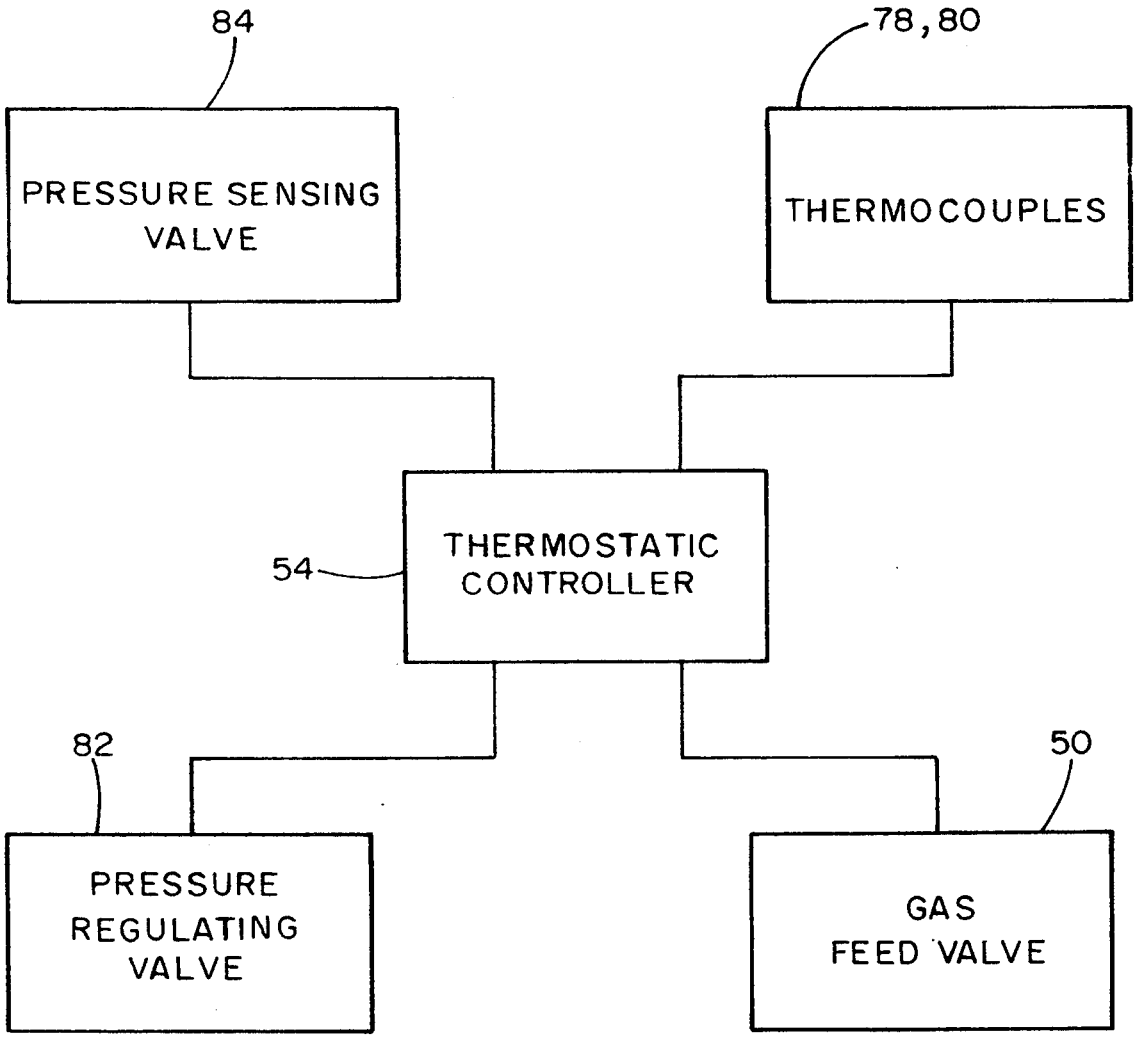
FIG. 3 is a block diagram of the control loop of the self-contained cooler/freezer apparatus of the present invention.

FIG. 3 is a block diagram representation of the control loop of the self-contained cooler/freezer apparatus 10. As is illustrated in FIG. 3, the thermostatic controller 54 operates in conjunction with the pressure sensing valve 84, the thermocouples 78 and 80, the pressure regulating valve 82 and the gas feed valve 50.

Regulating the pressure within the pressurized coolant compartment 34 provides for highly accurate results especially when only small changes in temperature are required. If only a slight change in temperature is required, one would want to release gaseous carbon dioxide which is as close as possible to the desired temperatures to avoid large temperature swings. Accordingly, one would use the pressure regulating valve 82 to increase the pressure within the pressurized coolant compartment 34 and achieve the warmer desired temperature for the gaseous carbon dioxide. Conversely, the pressure regulating valve 82 can be used to decrease the pressure within the pressurized coolant compartment 34 and achieve the cooler desired temperature for the gaseous carbon dioxide.

To account for uncertainties in predicting heat loads during a long duration transport, the insulated container 12 can be supplied with a water or ice filled pallet 92 positioned at the bottom of the first portion 60 of the insulated container 12. The design of this pallet 92 will include water permanently encapsulated in a "waffle" design plastic enclosure. The pallet 92 will be wide and lengthy but very shallow, for example, 1 to 2 inches deep. The pallet 92 comprises openings 94 which provide for the free circulation of gaseous carbon dioxide in the same manner as the ridges 56 in the base 16 of the insulated contained 12. Installed in the bottom of the insulated container 12, the pallet 92 will be conditioned to approximately the same temperature as the items 58 being shipped. Thus for refrigerated shipments the temperature may be at 35 degrees Fahrenheit (i.e., water) while for frozen shipments it may be at −10 degrees Fahrenheit (i.e., ice). The heat of fusion of the water or ice will provide a considerable buffer preventing fresh shipments from freezing and frozen shipments from thawing. For example 100 lbs of water would provide a buffer of 10,000 BTU, which is the quantity of heat required to freeze water or thaw ice at 32 degrees Fahrenheit.

Although shown and described is what are believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be constructed to cohere with all modifications that may fall within the scope of the appended claims.

What is claimed is:

1. A self-contained cooler/freezer apparatus for holding and preserving items which need to be stored at refrigerated or frozen temperatures, said apparatus comprising:

(a) a container having an insulated shell and an access doorway and door, a first portion of said container being adapted to hold said items;

(b) a pressurized coolant compartment constructed within a second portion of said container for holding solid carbon dioxide, said pressurized coolant compartment comprising a plurality of removable insulation panels for controlling heat energy transfer from said first portion to said solid carbon dioxide contained in said pressurized coolant compartment; and (c) temperature control means for maintaining the temperature within the first portion of said container at a predetermined value, said temperature control means comprising means for setting the temperature at said predetermined value, at least one temperature sensing device mounted within said first portion of said container, means for controlling the temperature at which said solid carbon dioxide sublimates, and means for circulating gaseous carbon dioxide formed by the sublimation of said solid carbon dioxide throughout said container.

2. The self-contained cooler/freezer apparatus according to claim 1, further comprising a pressure relief valve mounted in said first portion of said container, said pressure relief valve being operable to maintain the pressure within said container below a predetermined maximum value.

3. The self-contained cooler/freezer apparatus according to claim 2, wherein said container being substantially rectangular in shape comprises first and second side walls, a pair of end walls, one of said pair of end walls having said access doorway and door mounted therein, a top, and a base, said first and second side wails, said pair of end walls, said top, and said base each being formed from an inner and outer shell with an insulative material sandwiched therebetween.

4. The self-contained cooler/freezer apparatus according to claim 3, wherein said inkier shells of said first and second side walls comprise corrugations for providing increased circulation of said gaseous carbon dioxide.

5. The self-contained cooler/freezer apparatus according to claim 4, wherein said base comprises ridges formed on its inner shell for providing increased circulation of said gaseous carbon dioxide.

6. The self-contained cooler/freezer apparatus according to claim 5, wherein said pressurized coolant compartment being substantially rectangular in shape comprises a pair of side walls, a front wall, a rear wall, a base, a top frame, and a coolant compartment access door mounted to said top frame, said pressurized coolant compartment is formed from a thermally conductive material and is mounted in the upper rear portion of said container such that said coolant compartment access door is immediately above said top of said container.

7. The self-contained cooler/freezer apparatus according to claim 6, wherein said pressurized coolant compartment further comprises a plurality of fins mounted to the external surface of one of said pair of side walls, said front wall, and said base for facilitating heat transfer, and means for mounting at least one removable insulation panel to the internal surface of one of said pair of side walls, said front wall, and said base.

8. The self-contained cooler/freezer apparatus according to claim 7, wherein said means for setting the temperature is a thermostatic controller which is responsive to said at least one temperature sensing device, said thermostatic controller being operable to control said means for circulating and said means for controlling the temperature at which sublimation occurs.

9. The self-contained cooler/freezer apparatus according to claim 8, wherein said at least one temperature sensing device is a thermocouple, said thermocouple is disposed within a heat conductive material for providing a thermal inertia thereby more closely reflecting the temperature of said items.

10. The self-contained cooler/freezer apparatus according to claim 9, wherein said means for circulating comprises a solenoid actuated gas feed valve for circulating said gaseous carbon dioxide throughout said first portion.

11. The self-contained cooler/freezer apparatus according to claim 10, wherein said means for controlling the temperature at which sublimation occurs comprises:

a pressure sensing device mounted within said pressurized coolant compartment; and a pressure regulating valve, said thermostatic controller being responsive to said pressure sensing device and operable to control said pressure regulating valve to vent gasous carbon dioxide to the external ambient environment to lower the pressure within said pressurized coolant compartment thereby decreasing the temperature at which sublimation occurs.

12. The self-contained cooler/freezer apparatus according to claim 11, further comprising a battery for supplying power to said thermostatic controller, said solenoid actuated gas feed valve, said pressure sensing device, and said pressure regulating valve.

13. The self-contained cooler/freezer apparatus according to claim 1, further comprising a pallet positioned at the base of said container, said pallet being filled with a material conditioned to approximately the same temperature as of said items, wherein said material acts as a buffer to prevent rapid temperature changes of said items.

14. A self-contained cooler/freezer apparatus for holding and preserving items which need to be stored at refrigerated or frozen temperatures, said apparatus comprising:

(a) a container having an insulated shell and an access doorway and door, a first portion of said container being adapted to hold said items;

(b) a pressurized coolant compartment constructed within a second portion of said container for holding solid carbon dioxide, said pressurized coolant compartment comprising a plurality of removable insulation panels for controlling heat energy transfer from said first portion to said solid carbon dioxide contained in said pressurized coolant compartment;

(c) temperature control means for maintaining the temperature within the first portion of said container at a predetermined value, said temperature control means comprising a thermostatic controller for setting the temperature at said predetermined value, at least one thermocouple mounted within said first portion of said container, a pressure regulating valve for controlling the temperature at which said solid carbon dioxide sublimates, a pressure sensing device for measuring the pressure within said pressurized coolant compartment, and a solenoid actuated gas feed valve for circulating gaseous carbon formed by the sublimation of said solid carbon dioxide throughout said container;

(d) a pressure relief valve mounted in said first portion of said container, said pressure relief valve being operable to maintain the pressure with said container below a predetermined maximum value; and (e) a battery for supplying power to said thermostatic controller, said solenoid actuated gas feed valve, said pressure sensing device, and said pressure regulating valve.

15. The self-contained cooler/freezer apparatus according to claim 14, wherein said container being substantially rectangular in shape comprises first and second side walls, a pair of end walls, one of said pair of end walls having said access doorway and door mounted therein, a top, and a base, said first and second side walls, said pair of end walls, said top, and said base each being formed from an inner and outer shell with an insulative material sandwiched there between.

16. The self-contained cooler/freezer apparatus according to claim 15, wherein said inner shells of said first and second side walls comprise corrugations for providing increased circulation of said gaseous carbon dioxide.

17. The self-contained cooler/freezer apparatus according to claim 16, wherein said base comprises ridges formed on its inner shell for providing increased circulation of said gaseous carbon dioxide.

18. The self-contained cooler/freezer apparatus according to claim 15, wherein said inner and outer shells are formed from aluminum, and said insulative material being a polyurethane insulation.

19. The self-contained cooler/freezer apparatus according to claim 15, wherein said inner and outer shells are formed from fiberglass, and said insulative material being a polyurethane insulation.

20. The self-contained cooler/freezer apparatus according to claim 15, wherein said pressurized coolant compartment being substantially rectangular in shape comprises a pair of side walls, a front wall, a rear wall, a base, a top frame, and a coolant compartment access door mounted to said top frame, said pressurized coolant compartment is formed from a thermally conductive material and is mounted in the upper rear portion of said container such float said coolant compartment access door is immediately above said top of said container.

21. The self-contained cooler/freezer apparatus according to claim 20, wherein said pressurized coolant compartment further comprises a plurality of fins mounted to the external surface of one of said pair of side walls, said front wall, and said base for facilitating heat transfer, and means for mounting at least one removable insulation panel to the internal surface of one of said pair of side walls, said front wall, and said base.

22. The self-contained cooler/freezer apparatus according to claim 21, wherein said thermally conductive material is aluminum, and said plurality if removable insulation panels are formed from a polyurethane.

23. The self-contained cooler/freezer apparatus according to claim 22, wherein said pressurized coolant compartment further comprises a dry ice support shelf.

24. The self-contained cooler/freezer apparatus according to claim 23, wherein said thermostatic controller being responsive to said at least one thermocouple and said pressure sensing device controls said pressure regulating valve and said solenoid actuated gas feed valve.

25. The self-contained cooler/freezer apparatus according to claim 24, wherein said thermocouple is disposed within a heat conductive material for providing a thermal inertia thereby more closely reflecting the temperature of said items.

26. The self-contained cooler/freezer apparatus according to claim 14, further comprising a pallet positioned at the base of said container, said pallet being filled with a material conditioned to approximately the same temperature as of said items, wherein said material acts as a buffer to prevent rapid temperature changes of said items.

27. A method for holding and preserving items which need to be stored at refrigerated or frozen temperatures, said method comprising the steps of:

(a) positioning said items within a first portion of an insulated container;

(b) loading solid carbon dioxide into a pressurized coolant compartment within a second portion of said insulated container; and (c) controlling and maintaining the temperature within said first portion of said insulated container utilizing said solid carbon dioxide as a heat sink by calculating the quantity of said solid carbon dioxide necessary to absorb a given heat load, and adding a predetermined amount of insulation, in the form of insulating panels, to said pressurized coolant compartment in order to control the transfer rate of heat energy into said solid carbon dioxide, and by circulating gaseous carbon dioxide formed by the sublimination of said solid carbon dioxide throughout said insulated container by measuring container, comparing the first portion of said insulated container, comparing the measured temperature with a predetermined temperature value, actuating a solenoid actuated gas feed valve to circulate said gaseous carbon dioxide if the temperature within said portion of said insulated container is above said predetermined temperature, and controlling the pressure within said pressurized coolant compartment by controllably venting gaseous carbon dioxide to the external ambient environment through a pressure regulating valve, thereby controlling the temperature of said gaseous carbon dioxide.

* * * * *